US006524196B1

(12) United States Patent
Yeh

(10) Patent No.: US 6,524,196 B1
(45) Date of Patent: Feb. 25, 2003

(54) METHOD OF FORMING PATTERNS, TRADEMARKS AND BALANCE WEIGHT IN A GOLF CLUB HEAD AND PRODUCT USING THE SAME

(76) Inventor: Wang-Chiu Yeh, No. 34, Feng-Hua Street, Hua-Mei Tsun, Niao-Sang Hsiang, Kaohsiung Hsien (TW)

( * ) Notice: Subject to any disclaimer, the term of this patent is extended or adjusted under 35 U.S.C. 154(b) by 302 days.

(21) Appl. No.: 09/685,021

(22) Filed: Oct. 10, 2000

(51) Int. Cl.[7] ..... B23P 13/04; B21D 11/126

(52) U.S. Cl. ..... 473/324; 473/335; 473/349; 473/350; 29/558; 29/527.6

(58) Field of Search ..... 473/409, 334, 473/335, 330, 348, 349, 350, 324; 148/522; 29/527.6, 558

(56) References Cited

U.S. PATENT DOCUMENTS 5,800,285 A * 9/1998 Thorne et al. ..... 473/324
6,425,831 B1 * 7/2002 Heene et al. ..... 473/332
6,440,010 B1 * 8/2002 Deshmukh ..... 473/335

* cited by examiner

*Primary Examiner*—Paul T. Sewell
*Assistant Examiner*—Sneh Varma
(74) *Attorney, Agent, or Firm*—Birch, Stewart, Kolasch & Birch, LLP

(57) ABSTRACT

A method of forming patterns, trademarks and balance weight in a golf club head includes fabricating a rough working piece of the club head which has a trough located at a lower portion and reverse recesses for selected patterns and trademarks located at an upper portion thereof. Then fill and stuff the trough and recesses with a metallic material different from the club head that has a lower melting point (such as copper powder). Thereafter the stuffed recesses and trough and rough working piece of the club head are heated until the stuffed metallic material melted to form a strong binding with the rough working piece. Then grinding the rear side of the stuffed patterns and trademarks to expose the patterns and trademarks. The stuffed material in the trough becomes a balance weight. Finally to engage a hitting plate with a front circumferential edge of the trough to form a finished club head. The patterns and trademarks thus formed may be held securely in the club head without getting loose even under repeatedly heavy hitting and vibration.

4 Claims, 5 Drawing Sheets

METHOD OF FORMING PATTERNS, TRADEMARKS AND BALANCE WEIGHT IN A GOLF CLUB HEAD AND PRODUCT USING THE SAME

BACKGROUND OF THE INVENTION

This invention relates to a method of forming patterns, trademarks and balance weight in a golf club head and a product made by using the method.

A conventional golf club head usually has a sole at a rear side carved with a recess portion. The recess is then traced with selected patterns, trademarks and the like. Although it may serve some identification and ornament purpose, it does not give high quality image and is not very appealing.

Some golf club producers have offered golf club heads with recesses formed in selected patterns and trademarks at the rear side. The recesses are then filled or embedded with same metallic material as the heads. Afterward, the embedded material is ground to smooth the rear surface of the head. The patterns and trademarks being formed have a higher quality appearance. However after repetitive heavy hitting and huge vibration incurred to the head, the filled patterns and trademarks could become loose and break away. There is still room for improvement.

SUMMARY OF THE INVENTION

It is an object of this invention to provide a golf club head that has patterns, trademarks and balance weight located therein securely without getting loose or breaking away even under heavy hitting and vibration.

In one aspect, the golf club head according to this invention has a trough formed in a lower portion above a hitting plate and recesses formed in the formats of selected patterns and trademarks at an upper portion which are integrally formed with the crude working piece of the head. Then the recesses and trough are filled and stuffed with a metallic material different from the head (such as copper powder). The rough working piece and stuffed recesses and trough are heated at a high temperature until the metallic material is melt and stuck to the surfaces of the recesses and trough and fill the head to form an integral body (as shown in FIG. 3). The rear side of the patterns and trademarks are then being ground to reveal the patterns and trademarks at the rear side of the head (as shown in FIG. 4). The filled metallic material in the trough becomes the balance weight. Thereafter, the front circumferential edge of the trough is covered by and engaged with a hitting plate to complete the head (FIG. 3). The patterns and trademarks formed by the method set forth above have strong binding force and are less likely to get loose or breaking away even under vibration resulting from heavy hitting on the head. The balance weight may also have better effect.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENTS

Figure 1:
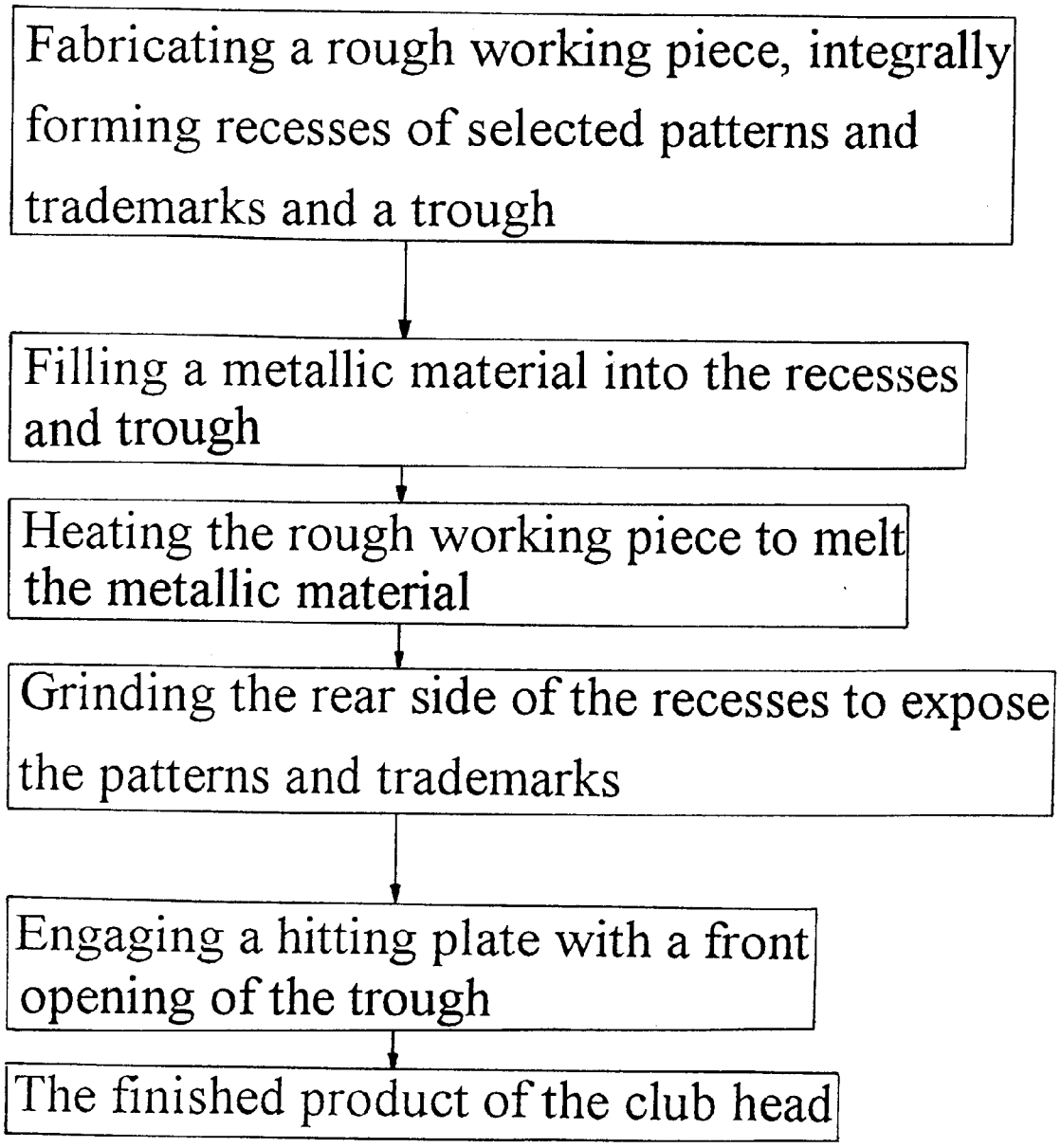
FIG. 1 is a process flow of the method of this invention.
Figure 2:
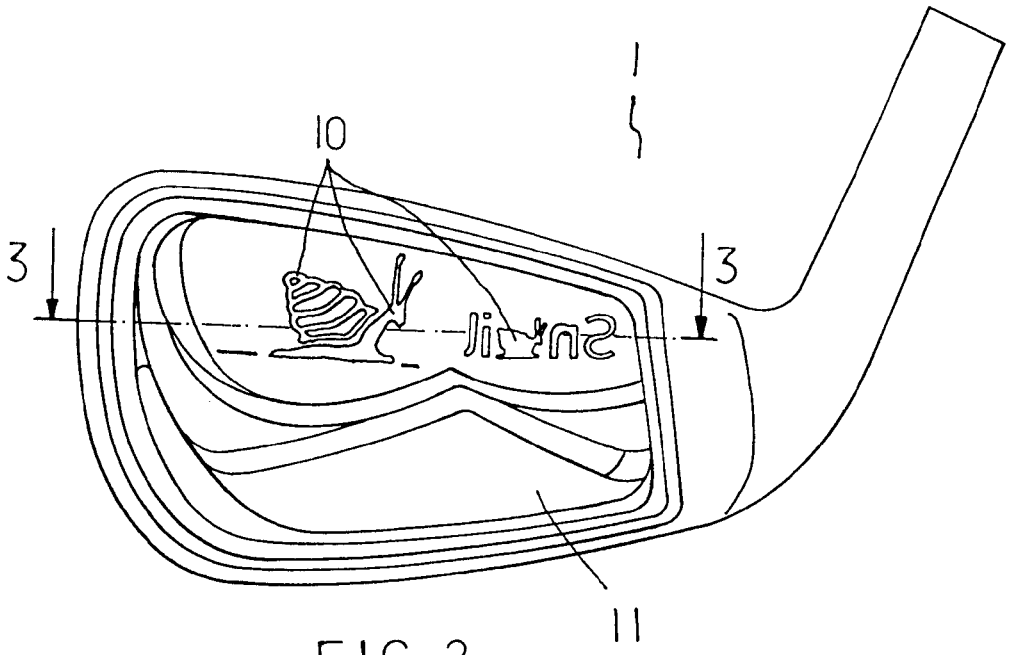
FIG. 2 is a front view of a club head of this invention, prior to filling.
Figure 3:
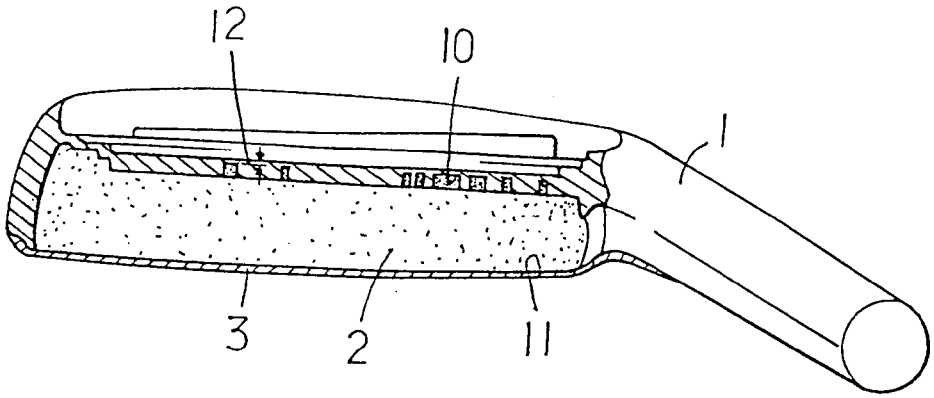
FIG. 3 is a sectional view of a club head of this invention taken on line 3—3 in FIG. 2, after filled and capped with a hitting plate.

Referring to FIGS. 1 and 2, the method according to this invention including the following steps:

a. fabricating a rough working piece:
Fabricating a rough working piece of a club head 1 including integrally formed reverse recesses 10 of selected patterns and trademarks 13 at an upper portion of the club head 1 and a trough 11 in a lower portion of a front edge thereof.

b. filling metallic material:
Filling a metallic material (such as copper powder) different from the club head 1 into the recesses 10 for forming stuffed patterns and trademarks 13 and into the trough 11 for forming a balance weight 2.

c. heating treatment:
Heating the club head 1 and the stuffed recesses 10 and trough 11 under a selected high temperature for the metallic material to melt and making binding surface contact with the rough working piece of the club head 1.

d. grinding process:
Grinding a rear side 12 of the recesses 10 to expose the patterns and trademarks 13 (shown in FIGS. 3 and 4).

e. engaging the hitting plate:
Fixedly engaging a hitting plate 3 with a front circumferential edge 14 of the trough 11 to form a finished product of the club head 1. The patterns and trademarks 13 and balance weight 2 thus may be held securely in the club head 1 without loosing or breaking away even under repeatedly heavy hitting and vibration.

Figure 5:
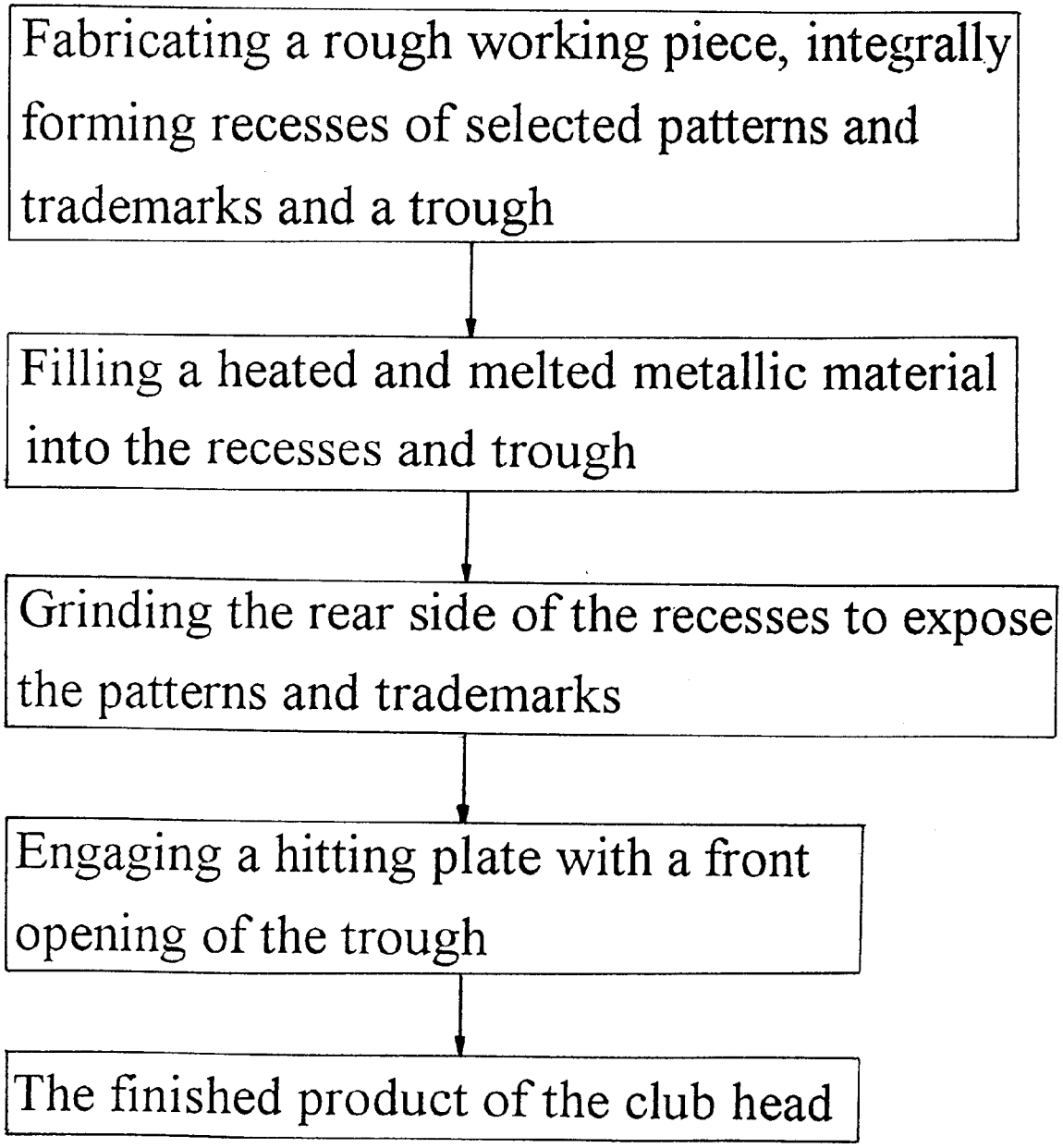
FIG. 5 is an another process flow of the method of this invention.

FIG. 5 shows another process flow of this invention, which includes the following steps:

a. fabricating a rough working piece:
Fabricating a rough working piece of a club head 1 including a trough 11 in a lower portion thereof and reverse recesses 10 of selected patterns and trademarks 13 at an upper portion of the club head 1.

b. filling heated and melted metallic material:
Filling a heated and melted metallic material (such as copper powder) different from the club head 1 into the recesses 10 and trough 11 for forming the stuffed patterns, trademarks 13 and balance weight 2.

c. grinding process:
Grinding a rear side 12 of the recesses 10 to expose the patterns and trademarks 13 (shown in FIGS. 3 and 4).

d. engaging the hitting plate:
Fixedly engaging a hitting plate 3 with a front circumferential edge 14 of the trough 11. Then a finished product of the club head 1 with the patterns and trademarks 13 and balance weight 2 firmly embedded therein is completed.

Figure 7:
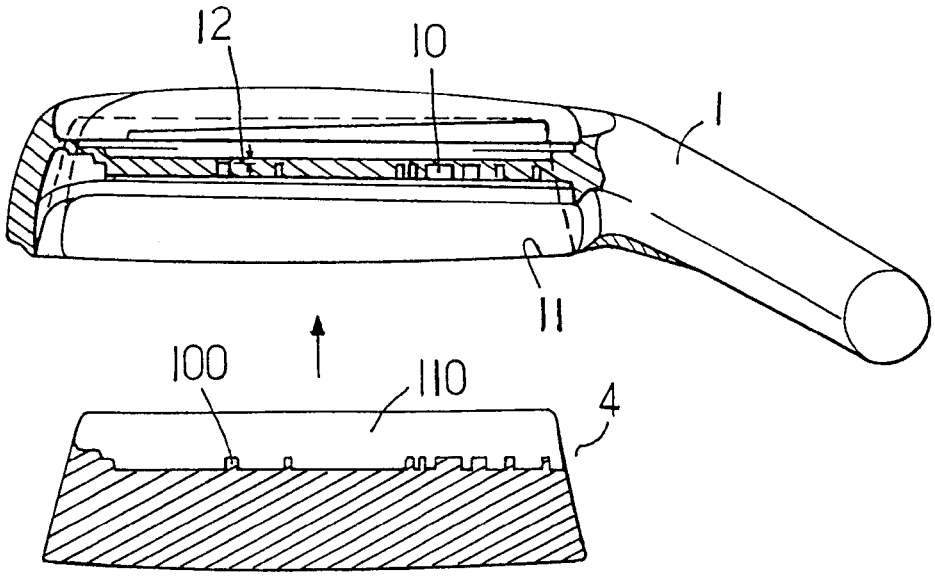
FIG. 7 is a breakaway sectional view of a club head made according the method shown in FIG. 6.
Figure 4:
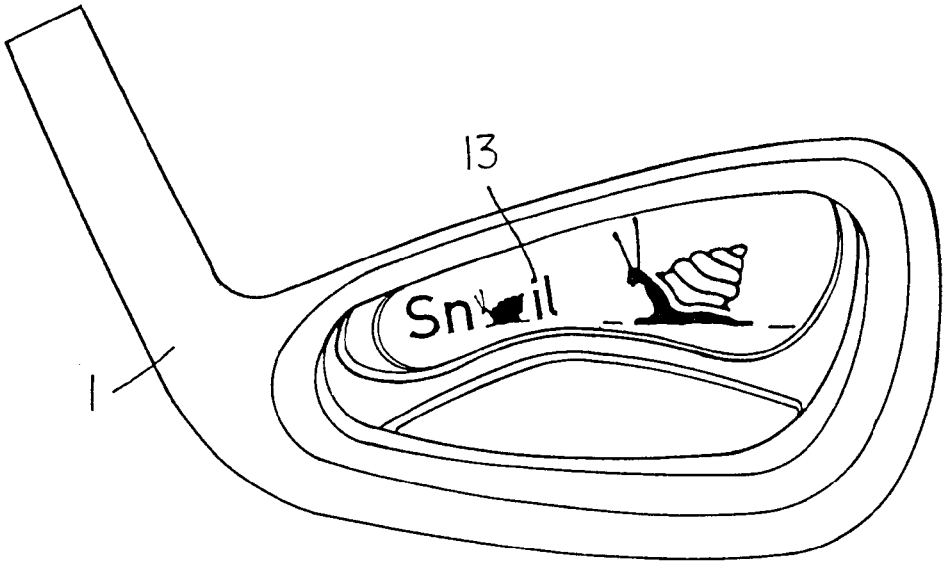
FIG. 4 is a rear view of a club head of this invention, after ground.
Figure 6:
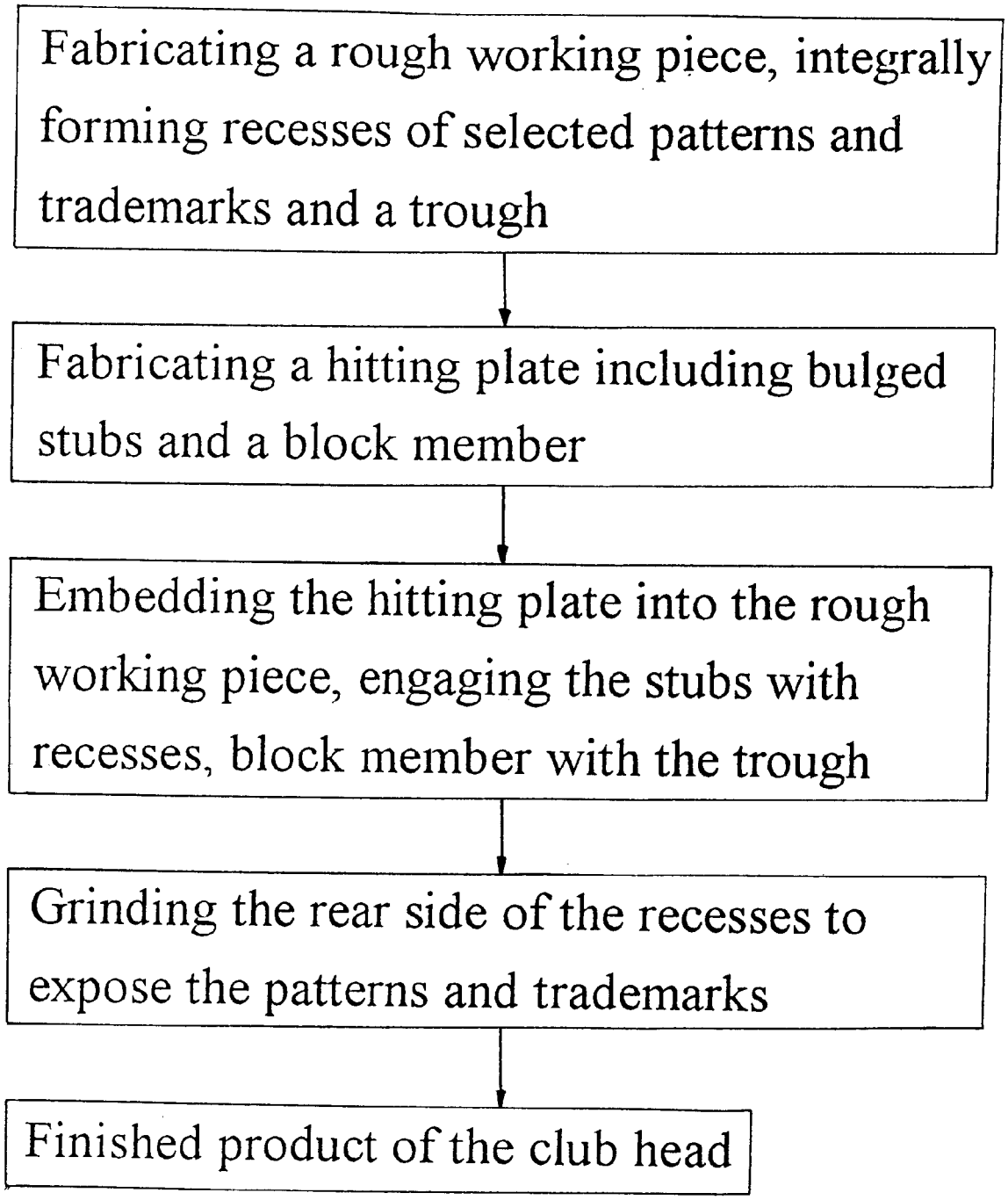
FIG. 6 is a further process flow of the method of this invention.

FIG. 6 shows a further process according to this invention, which includes the following steps:

a. fabricating a rough working piece:

Fabricating a rough working piece of a club head 1 including a trough 11 in a lower portion thereof and reverse recesses 10 of selected patterns and trademarks 13 at an upper portion of the club head.

b. fabricating a hitting plate:

Fabricating a hitting plate 4 which includes bulged stubs 100 mating and engagable with the recesses 10, and a block member 110 mating and engageable with the trough 11 (FIG. 7).

c. engaging the hitting plate:

Embedding the hitting plate 4 into the rough working piece by engaging the bulged stubs 100 with the recesses 10, and the block member 110 with the trough 11 to form a firm and secure binding.

d. grinding process:

Grinding a rear side 12 of the recesses 10 to expose the patterns and trademarks 13 (FIG. 4).

By means of this invention, the patterns, trademarks and balance weight are formed by melting a metallic material to make close surface contact with the rough working piece of a club head. The binding force is strong and may endure vibration resulting from hitting on the club head without the patterns, trademarks and balance weight getting loose or breaking away.

What is claimed is:

1. A method of forming patterns, trademarks and balance weight in a golf club head, comprising:

a. fabricating a rough working piece of the club head including integrally formed reverse recesses of selected patterns and trademarks at an upper portion of the club head and a trough in a lower portion of a front edge thereof, b. filling a metallic material different from the club head into the recesses for forming stuffed patterns and trademarks and into the trough for forming a balance weight, the metallic material being selected from the group consisting of copper powder, c. heating the club head and the stuffed recesses and trough at a selected temperature for the metallic material to melt and making binding contact with the working piece of the club head, d. grinding a rear side of the stuffed recesses to expose the patterns and trademarks, and e. fixedly engaging a hitting plate with a front circumferential edge of the trough such that the patterns, trademarks and balance weight are secured in the club head without getting loose under vibration resulting from hitting on the club head.

2. The golf club head made according to claim 1, wherein the golf club head has a rear side opposite to the hitting plate showing the patterns and trademarks.

3. A method of forming patterns, trademarks and balance weight in a golf club head, comprising:

a. fabricating a rough working piece of the club head including reverse recesses of selected patterns and trademarks at an upper portion of the club head and a trough in a lower portion of a front edge thereof, b. filling a heated and melted metallic material different from the club head into the recesses for forming stuffed patterns and trademarks and into the trough for forming a balance weight, the metallic material being selected from the group consisting of copper powder, c. grinding a rear side of the stuffed recesses to expose the patterns and trademarks, and d. fixedly engaging a hitting plate with a front circumferential edge of the trough for holding the patterns, trademarks and balance weight in the club head.

4. A method of forming patterns, trademarks and balance weight in a golf club head, comprising:

a. fabricating a rough working piece of a club head including reverse recesses of selected patterns and trademarks at an upper portion of the club head and a trough in a lower portion of a front edge thereof, b. fabricating a hitting plate including bulged stubs mating and engagable with the recesses, and a block member mating and engageable with the trough, c. fixedly embedding the hitting plate into the rough working piece for engaging the bulged stubs with the recesses, and the block member with the trough to form a firm and secure binding, and d. grinding a rear side of the recesses to expose the patterns and trademarks.

* * * * *